US009650804B1

(12) United States Patent
Rosales

(10) Patent No.: US 9,650,804 B1
(45) Date of Patent: May 16, 2017

(54) AUTOMOBILE TENT APPARATUS

(71) Applicant: Marsha Rosales, Berryville, AR (US)

(72) Inventor: Marsha Rosales, Berryville, AR (US)

( * ) Notice: Subject to any disclaimer, the term of this patent is extended or adjusted under 35 U.S.C. 154(b) by 0 days.

(21) Appl. No.: 15/266,631

(22) Filed: Sep. 15, 2016

(51) Int. Cl.
*E04H 15/06* (2006.01)
*E04H 15/20* (2006.01)
*E04H 15/00* (2006.01)

(52) U.S. Cl.
CPC ..... *E04H 15/06* (2013.01); *E04H 15/006* (2013.01); *E04H 15/20* (2013.01); *E04H 2015/201* (2013.01); *E04H 2015/206* (2013.01)

(58) Field of Classification Search
CPC ..... E04H 15/006; E04H 15/04; E04H 15/06; E04H 15/20; E04H 2015/201
See application file for complete search history.

(56) References Cited

U.S. PATENT DOCUMENTS 2,754,836 A * 7/1956 Darby ..... E04H 15/20 52/2.21
2,915,074 A * 12/1959 Cameto ..... A61G 10/04 52/2.21
3,696,449 A 10/1972 Smith
3,746,386 A 7/1973 Woodward
RE29,264 E 6/1977 Woodward
4,300,797 A 11/1981 Whitley et al.
4,556,391 A * 12/1985 Tardivel ..... A63H 33/00 135/125
4,819,389 A * 4/1989 Kihn ..... E04H 15/20 135/97
5,570,544 A * 11/1996 Hale ..... E04H 15/20 52/2.11
5,692,795 A * 12/1997 Mininger ..... E04H 15/20 135/88.13
D396,087 S * 7/1998 Liu ..... D21/835
5,971,487 A 10/1999 Passehl
5,987,822 A * 11/1999 McNiff ..... E04H 15/20 135/125
6,623,322 B1 * 9/2003 Lesniak ..... B63B 7/085 114/345
6,722,084 B2 * 4/2004 Berman ..... E04H 15/006 135/120.1
6,752,164 B1 * 6/2004 Park ..... E04H 15/006 135/124

(Continued)

*Primary Examiner* — Robert Canfield
(74) *Attorney, Agent, or Firm* — Dale J. Ream

(57) ABSTRACT

An automobile tent apparatus includes a body member that includes an inflatable framework having opposed front and back support members each having opposed proximal and distal ends and a first dome support member extending between opposed proximal ends of the front and back support members, respectively, the front, back, and first dome support members having a tubular construction in fluid communication with one other and are selectively inflatable with air. The first dome support member has an upwardly arching configuration relative to the front and back support members. A plurality of housing panels is attached to respective support members of the inflatable framework and each extends downwardly therefrom so as to define an interior area within the body member. A first upper panel is positioned atop the first dome support member that covers an upper extent of the interior area proximate the first dome support member.

20 Claims, 8 Drawing Sheets

(56) References Cited

U.S. PATENT DOCUMENTS

| | | | | |
|---|---|---|---|---|
| 6,929,016 | B2 * | 8/2005 | Lee | E04H 15/20 135/126 |
| 7,111,578 | B2 * | 9/2006 | Brooks | B63B 17/02 114/361 |
| 7,195,297 | B2 | 3/2007 | Murray et al. | |
| 7,261,375 | B2 | 8/2007 | Godshaw et al. | |
| 7,478,858 | B1 | 1/2009 | Brun | |
| 8,096,082 | B2 * | 1/2012 | Moran | E04H 1/1244 135/902 |
| 8,615,966 | B2 * | 12/2013 | Thompson | A63H 33/008 446/221 |
| 8,720,991 | B2 | 5/2014 | Macleod et al. | |
| 8,857,850 | B2 | 10/2014 | Avanian | |
| 9,366,050 | B1 * | 6/2016 | Ptaszek | E04H 6/44 |
| 2002/0180229 | A1 | 12/2002 | Wheat | |
| 2003/0213512 | A1 * | 11/2003 | Lee | E04H 15/20 135/126 |
| 2004/0050411 | A1 * | 3/2004 | Lawrence | E04H 15/20 135/128 |
| 2008/0210282 | A1 * | 9/2008 | Turcot | E04H 15/06 135/88.14 |
| 2011/0042989 | A1 | 2/2011 | Heller | |
| 2012/0273018 | A1 * | 11/2012 | Lamke | E04H 15/20 135/96 |

* cited by examiner

AUTOMOBILE TENT APPARATUS

BACKGROUND OF THE INVENTION

This invention relates generally to tent enclosures and, more particularly, to a tent apparatus configured for attachment to the seats and cabin ceiling of an automobile.

Tents are well known as temporary and portable shelters and convenient for activities such as camping. Sometimes, however, children find entertainment in setting up a tent in their backyard or at a non-camping overnight event as the idea of having a somewhat private and camp-like environment is exciting. For similar reasons, kids create entire castles and mazes in their basement or garage using large cardboard boxes.

Typically, a child cannot experience the atmosphere of a tent or private space while riding in a car. In fact, riding in the backseat of a car with other siblings and with his parents in close proximity is the absolute opposite of private! Others can look at whatever book, toy, or electronic device the others are viewing. And, even if alone, being surrounded by opaque or translucent walls would contribute to the private feelings that bring security and independence.

Therefore, it would be desirable to have a tent apparatus that that is inflatable for quick and easy setup within and removal from the passenger cabin of an automobile. Further, it would be desirable to have a tent apparatus that may be actually coupled to the ceiling and seats of the automobile for stability while the automobile is driving. In addition, it would be desirable to have a tent apparatus that includes opaque housing panels that are easily movable to give easy access to a child riding in the tent area.

SUMMARY OF THE INVENTION

An automobile tent apparatus configured for use in an automobile according to the present invention includes a body member that includes an inflatable framework having opposed front and back support members each having opposed proximal and distal ends and a first dome support member extending between opposed proximal ends of the front and back support members, respectively, the front, back, and first dome support members having a tubular construction in fluid communication with one other and are selectively inflatable with air. The first dome support member has an upwardly arching configuration relative to the front and back support members. A plurality of housing panels is attached to respective support members of the inflatable framework and extend downwardly therefrom so as to define an interior area within the body member. A first upper panel is positioned atop the first dome support member that covers an upper extent of the interior area proximate the first dome support member.

Therefore, a general object of this invention is to provide a tent apparatus that may be positioned in a rear seat of an automobile and automatically inflated to resemble a tent, castle, tree-house, or other private dwelling place and configured for children to sit therein while the automobile is driving.

Another object of this invention is to provide an automobile tent apparatus, as aforesaid, that may be physically coupled to the ceiling and seats of the automobile once inflated to provide stability against movement while driving.

Still another object of this invention is to provide an automobile tent apparatus, as aforesaid, that provides opaque housing panels for privacy but at least one window opening to enable a child to view outside of the tent.

Yet another object of this invention is to provide an automobile tent apparatus, as aforesaid, having an electrical inverter to provide current to the interior of the tent apparatus suitable for powering electronic devices.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
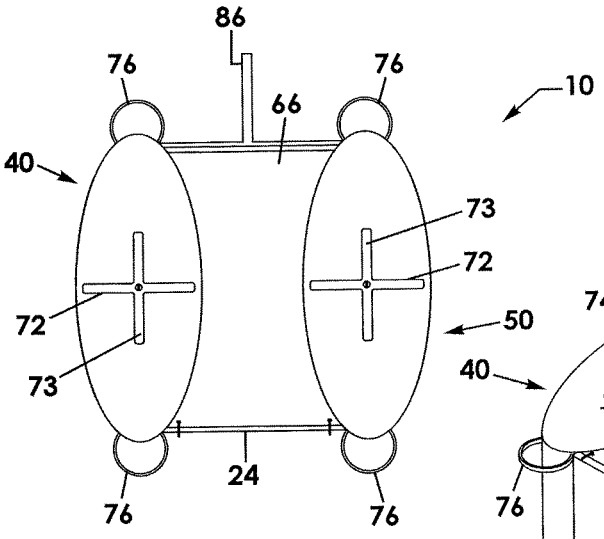
FIG. 1*a* is a top view of an automobile tent apparatus according to a preferred embodiment of the present invention.
Figure 1B:
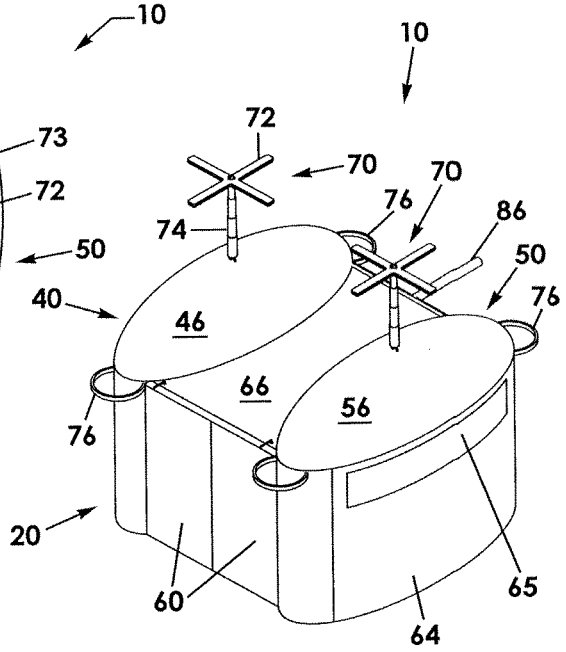
FIG. 1*b* is a perspective view of the tent apparatus as in FIG. 1*a;*
Figure 1C:
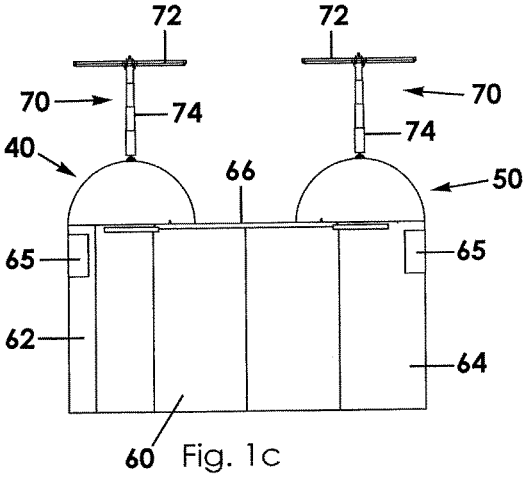
FIG. 1*c* is a front view of the tent apparatus as in FIG. 1*b;*

An automobile tent apparatus according to a preferred embodiment of the present invention will now be described with reference to FIGS. 1 to 7*c* of the accompanying drawings. The tent apparatus 10 includes a body portion 20 having an inflatable framework 22 and a plurality of housing panels that define an interior space that may be occupied by children when inflated and positioned in the rear seat of an automobile (not shown). The automobile tent apparatus 10 is designed and made for use and installation in the rear seat of an automobile. Specifically, this invention may be inflated and positioned in the rear seat of an automobile of a type having a front seat, rear seat, a passenger cabin having a ceiling, and a trunk. While the automobile itself is not a part of this invention, it will be referred to throughout the description below to give context to the features and configuration of the invention.

The tent apparatus 10 may include a body portion 20 having a structure capable of stable positioning in the rear seat of an automobile and defining an interior area in which one or more children may sit while riding in the car as will be described in more detail below. More particularly, the framework 22 includes a front support member 24 opposite and parallel to a back support member 30, both support members having a tubular construction that is inflatable.

Figure 2:
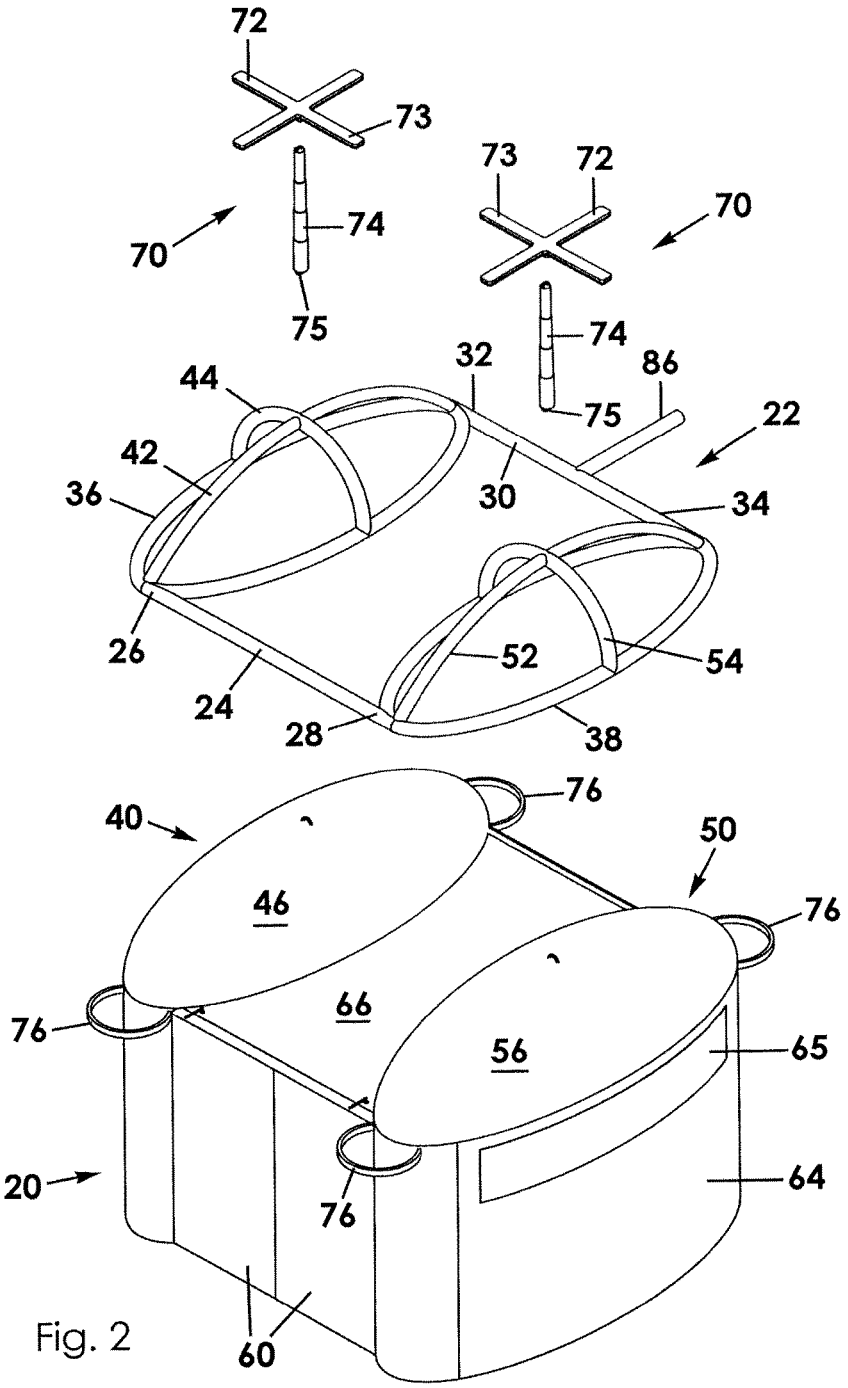
FIG. 2 is an exploded view of the tent apparatus as in FIG. 1*b;*
Figure 3A:
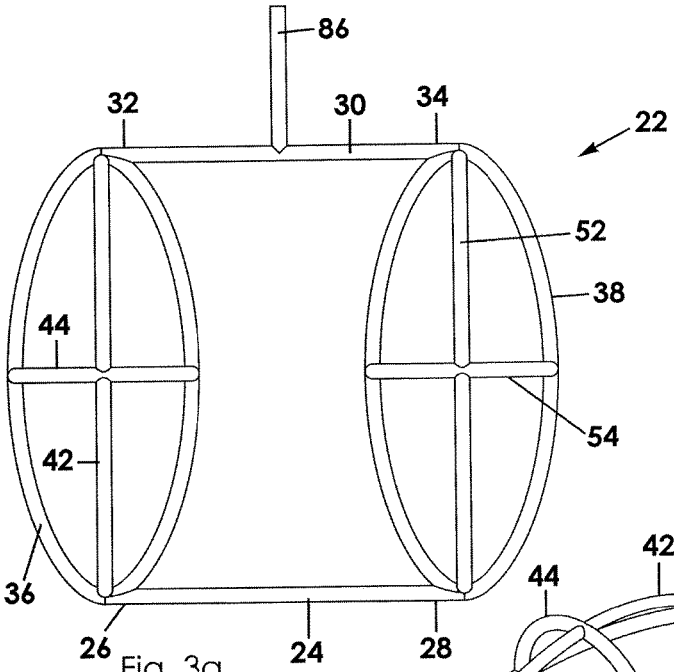
FIG. 3*a* is a top view of a framework removed from the body portion of the tent apparatus.
Figure 3B:
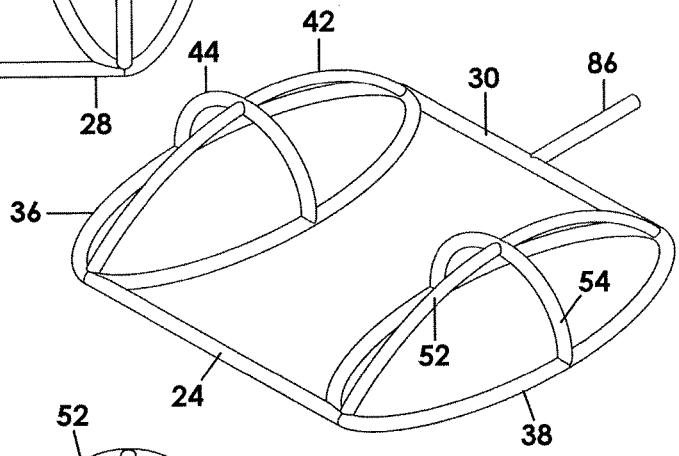
FIG. 3*b* is a perspective view of the framework as in FIG. 3*a;*
Figure 3C:
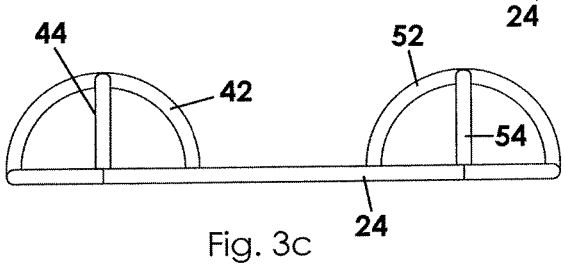
FIG. 3*c* is an end view of the framework as in FIG. 3*b;*

Further, a first end support member 36 extends between proximal ends 26, 32 of the front 24 and back 30 support members, respectively, and a second end support member 38 extends between distal ends 28 of the front 24 and back 30 support members, respectively. The first and second end support members 24, 30 may have a linear configuration and not extending upwardly or may, in an embodiment, have a generally annular configuration extending both inwardly and outwardly (FIG. 2). In either embodiment, the first end support member 36 is preferably within the same horizontal plane as that of the front 24 and back 30 support members. Similarly, the second end support member 38 has substantially the same configuration as the first end support member 36. It is understood that the first end support member 36 may be viewed as a base of a first dome assembly 40 and the second end support member 38 may be viewed as a base of a second dome assembly 50.

A first dome support member 42 extends between proximal ends 26, 32 of the front 24 and back 30 support members and also includes an inflatable construction. The first dome support member 42 may have an upwardly arched or generally arcuate configuration. Similarly a second dome support member 52 extends between distal ends 28, 34 of the front 24 and back 30 support members and also includes an inflatable construction. The second dome support member 52 may have an upwardly arched or generally arcuate configuration.

In an embodiment, a first auxiliary dome support member 44 may extend between opposed portions of the first end support member 36, also in an upwardly arched configuration and being parallel to the first dome support member 42. It is understood that the first auxiliary dome support member 44 enhances or makes possible that a first upper panel 46 will have an aesthetically pleasing domed configuration as shown in the figures.

Likewise, a second auxiliary dome support member 54 may extend between opposed portions of the second end support member 38, also in an upwardly arched configuration and being parallel to the second dome support member 52. It is understood that the second auxiliary dome support member 54 enhances or makes possible that a second upper panel 56 will have an aesthetically pleasing domed configuration as shown in the figures.

Preferably, all of the support members described above and those described below are in fluid communication so that they may be inflated with air together as will be described later.

The body portion 20 may also be referred to as a housing and is covered by a plurality of "housing panels" so as to define the interior area in which one or more children may sit and be entertained while riding in the rear seat of the automobile. The housing panels may be mounted atop the arched dome support members 42, 52 and may be coupled to front 24, back 30, and end support members 36, 38 and depend/hang therefrom. The housing panels may be durable such that posters, photographs, scripture verse cards, etc. may be adhesively attached.

More particularly, the plurality of housing panels includes at least one (and, preferably, two) front panel 60 coupled to the front support member 24 and hanging therefrom. In an embodiment, each housing panel has a generally opaque construction so a to inhibit viewing therethrough. The front panel 60 may be constructed of a flexible material such as fabric, thin polypropylene, nylon, or the like. Each front panel 60 may be movable between a closed configuration not providing visual access to the interior area and an open configuration providing visual and physical access to the interior area. For instance, a parent in the front seat of the car may desire to flip up a front panel 60 to look, speak, or otherwise communicate with a child riding in the tent apparatus 10. The front panel 60 and another panel proximate the front panel 60 may include complementary fasteners, such as hook and loop fasteners, so that an opened front panel 60 may be selectively held in an opened configuration if desired.

Further, the plurality of housing panels may include oppositely disposed first 62 and second 64 side panels coupled to and extending downwardly from first 36 and second 38 end support members of the framework 22, respectively. In an embodiment, each side panel 62, 64 may define a view opening 65 (also referred to as a window or aperture) so that an occupant of the interior area may look out, such as to look out a window of the vehicle. In addition, each side panel is constructed of a flexible material that is selectively movable between a closed configuration not providing visual access to the interior area and an open configuration providing visual and physical access to A side panel and another panel proximate the side panel may include complementary fasteners, such as hook and loop fasteners, so that an opened side panel may be selectively held in an opened configuration if desired.

In addition, each of the dome assemblies may be covered by a housing panel. More particularly, a first "upper panel" 46 is mounted to or positioned atop the first dome support member 42 and a second "upper panel" 56 is mounted to or positioned atop the second dome support member. As described above, the upper panels are configured in a domed configuration according to the configuration of the dome support members and auxiliary dome support members, respectively. An upper panel essentially covers and blocks from view the interior area beneath the dome support members.

Further, a top cover panel 66 may extend between the upper panels of the dome assemblies described above. To this extent, the interior area between the dome assemblies (in which children may be seated, respectively) provides a visual bridge in which they may talk, hand toys back and forth, and otherwise interact. In an embodiment, a divider or partition may be positioned in this bridge area so as to completely separate the dome assemblies and the children.

In another unique aspect, the body portion 20 may be mounted or coupled to an interior surface of the ceiling of the automobile passenger cabin so as to stabilize or substantially prevent movement of the body portion relative to the rear seat of the automobile. More particularly, a mounting member 70 includes a mounting flange 72 that may be in the form of a bracket having multiple contact points by which to connect to the cabin ceiling (FIG. 2). Further, the mounting member 70 may include a length-adjustable mounting rod 74 coupled to the mounting flange 72 and extending downwardly to a lower end 75. The lower end 75 of the mounting rod 74 is configured to be coupled to a respective upper panel of a dome assembly.

It is understood that the mounting rod 74 may have a telescopic configuration or another means for adjusting its length so that the tent apparatus 10 may be used in vehicles having a different sizes and configurations of passenger cabins. The mounting flange 72 may include a magnet or magnetic surface 73 having sufficient strength such that the mounting member 70 may be removably or releasably coupled to the inner surface of the passenger cabin.

In still another aspect, the automobile tent apparatus 10 may include at least one and preferably a plurality of stabilizing straps 76. A stabilizing strap 76 includes a loop of a durable material that may be coupled to one of the seats of the automobile cabin so as to further stabilize or prevent movement of the body portion 20 on the rear seat. More particularly, a stabilizing strap 76 may extend forwardly of the front of the body portion 20 and be configured to stretch or otherwise be releasably coupled to the front seat, such as to the headrest. In an embodiment, a stabilizing strap 76 may extend rearward of a back portion of the body portion 20 and be configured to be releasably coupled to the rear seat, such as to a head rest.

Figure 4A:
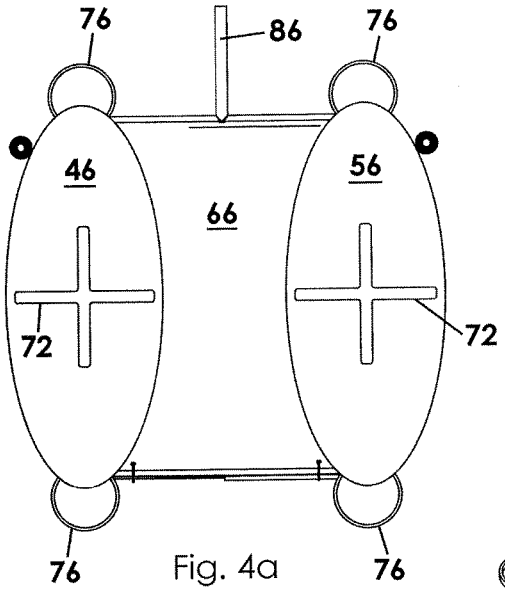
FIG. 4*a* is a top view of the tent apparatus of FIG. 1*a;*
Figure 4B:
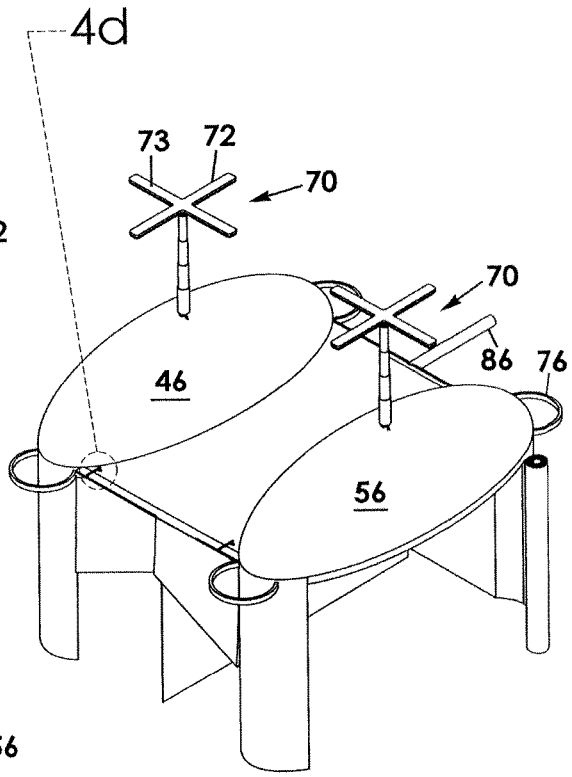
FIG. 4*b* is a perspective view of the tent apparatus as in FIG. 4*a;*
Figure 4C:
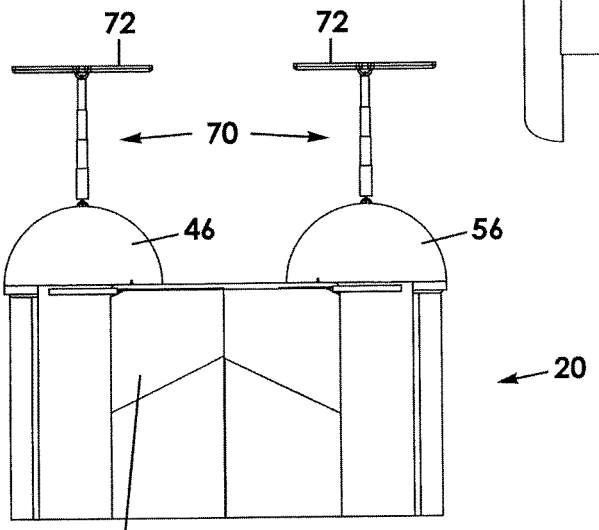
FIG. 4*c* is a front view of the tent apparatus as in FIG. 4*b;*
Figure 4D:
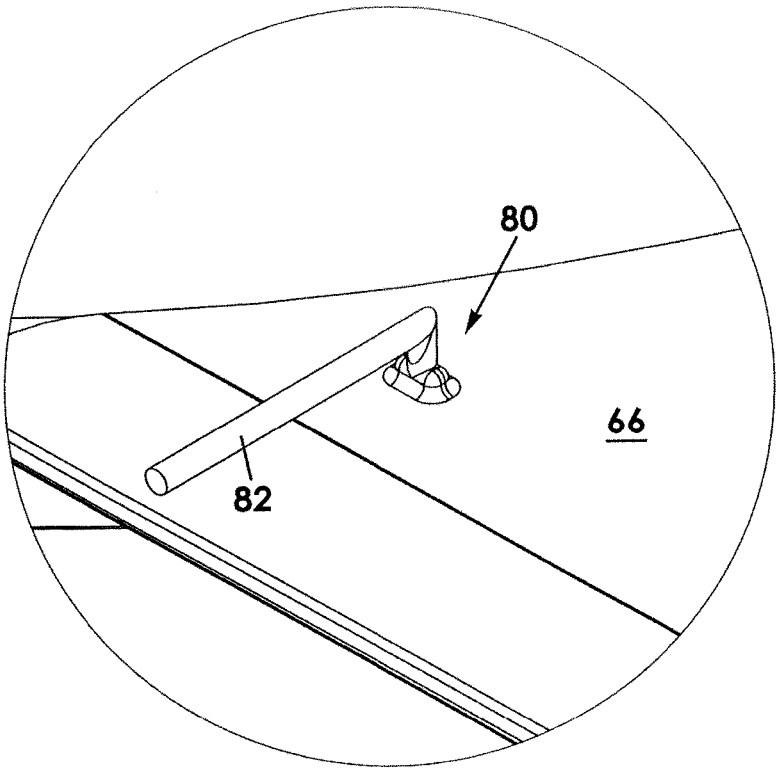
FIG. 4*d* is an isolated view on an enlarged scale taken from FIG. 4*b;*
Figure 5:
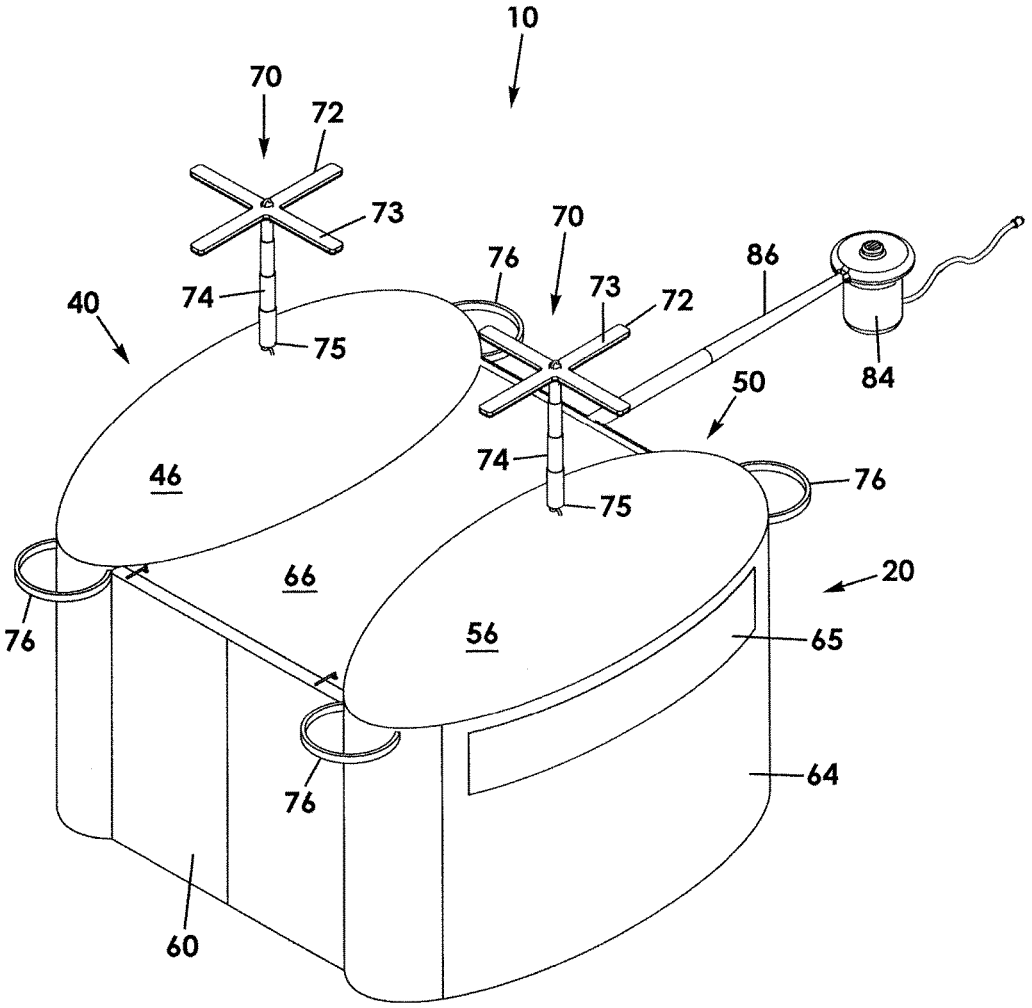
FIG. 5 is a perspective view of the automobile tent apparatus according to the present invention.
Figure 6A:
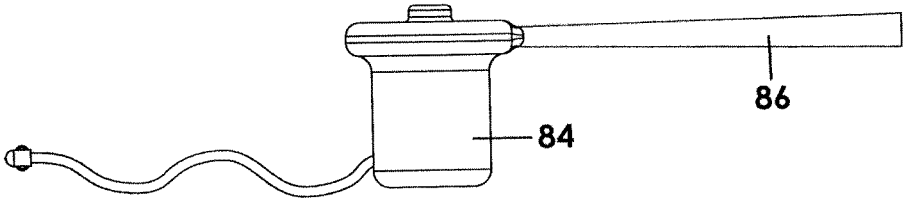
FIG. 6*a* is a side view of a suction device according to the present invention.
Figure 6B:
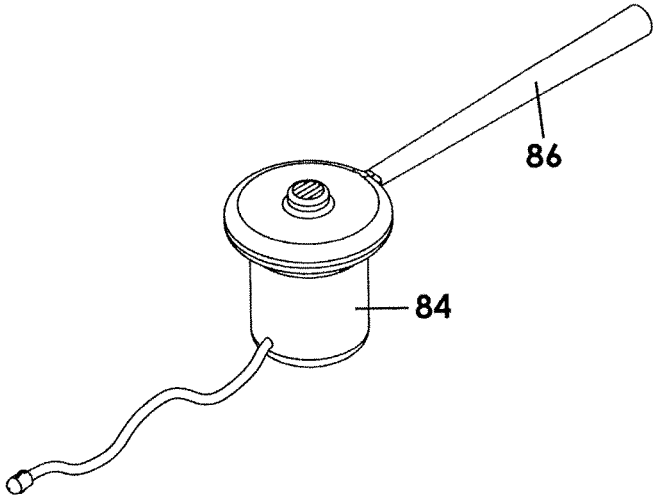
FIG. 6*b* is a perspective view of the suction device as in FIG. 6*a;*
Figure 6C:
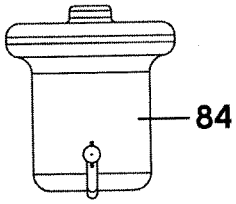
FIG. 6*c* is an end view of the suction device as in FIG. 1.

In addition, the automobile tent apparatus 10 may include a power inverter 80 configured for converting DC current from the automobile's battery to AC current suitable to power electronic devices such as an electronic tablet, a video player, to recharge a cellular phone, and the like. In use, a child riding within the interior area of the body portion 20 may bring along one or more electronic devices for entertainment purposes and may plug them into an extended length cable 82 of the power inverter 80 (FIG. 4*d*). The cable 82 of the power inverter 80 may extend upwardly through a top cover panel 66 or, alternatively, through another cover panel and be connected to the vehicle battery via the cigarette lighter or dedicated port.

Figure 7A:
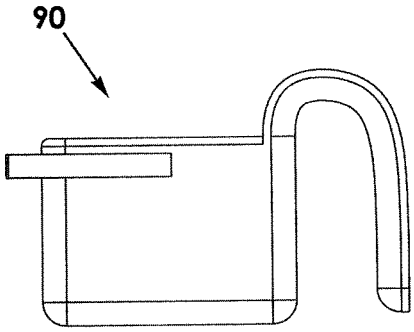
FIG. 7*a* is a side view of a carrying case according to the present invention.
Figure 7B:
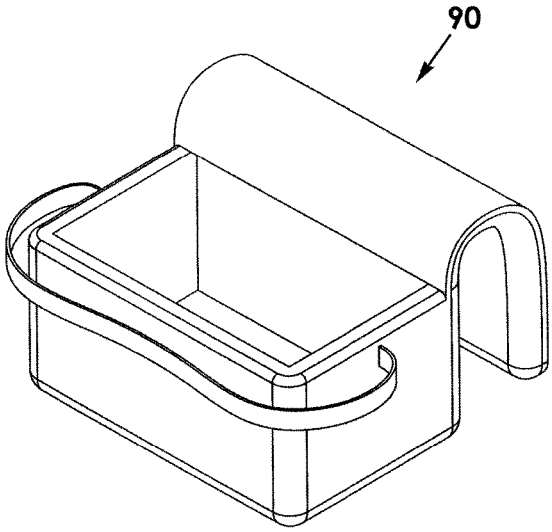
FIG. 7*b* is a perspective view of the carrying case as in FIG. 7*a*.
Figure 7C:
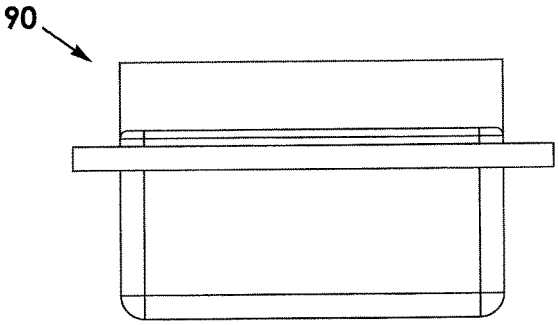
FIG. 7*c* is a front view of the carrying case as in FIG. 7*a*.

Further, the automobile tent apparatus 10 may include an air compressor 84 or similar inflation and deflation device in fluid communication with the inflatable framework 22 of the body portion 20. The air compressor 84 may be conveniently positioned in the trunk of the automobile and connected to the framework 22 via an inflation hose 86 and may be electrically connected to the automobile battery or to its own dedicated battery power source for selectively powering the device. When activated, the air compressor 84 is designed to quickly inflate the framework 22 to provide the expanded form shown in the figures. Selectively, the air compressor 84 can be reversed so as to withdraw air from the framework 22 and deflate the tent apparatus 10 to a compact form that may be removed from the vehicle and stored, such as in a storage case 90 (FIG. 7*b*). Thus, the tent apparatus 10 may be moved from vehicle to vehicle as desired, such as by a family who may choose to travel in more than one vehicle on various occasions or stored in the trunk or in a home when not in use.

In use, the tent apparatus 10 may first be positioned in the rear seat of an automobile while in a deflated configuration. Then, the air compressor 84 may be energized to inflate the tent apparatus 10. The mounting members 70 may be extended to be magnetically coupled to the vehicle cabin ceiling for stability as well as strapped to front or rear seat head rests for stability. One of more children may open the side panels 62, 64 as described above and take up positions in respective dome assemblies. The body portion 20 does not block or impede the vehicle's seat belts; thus, the children may be belted in place in a normal manner. Tucked away in their semi-private dome assembly, each child is able to have a feeling of privacy and adventure, play with electronic devices or traditional books, while still being accessible by adults in the front seat when needed or desired.

It is understood that while certain forms of this invention have been illustrated and described, it is not limited thereto except insofar as such limitations are included in the following claims and allowable functional equivalents thereof.

The invention claimed is:

1. An automobile tent apparatus configured for use in an automobile having a rear seat that extends substantially between opposed rear side doors, a front seat that extends substantially between opposed front side doors, and having a cabin ceiling above the front and rear seats, said automobile tent apparatus comprising:

a body member that includes an inflatable framework having opposed front and back support members each having opposed proximal and distal ends and a first dome support member extending between opposed proximal ends of said front and back support members, respectively, said front, back, and first dome support members having a tubular construction in fluid communication with one other and are selectively inflatable with air;

wherein said first dome support member has an upwardly arching configuration relative to said front and back support members;

a plurality of generally opaque housing panels attached to respective support members of said inflatable framework and extending downwardly therefrom so as to define an interior area within said body member;

a first upper panel positioned atop said first dome support member that covers an upper extent of said interior area proximate said first dome support member; and a first mounting member configured for selective attachment to an interior surface of the cabin ceiling of the automobile, said first mounting member being coupled to said first dome support member so that said inflatable framework is suspended from the cabin ceiling.

2. The automobile tent apparatus as in claim 1, wherein said first mounting member is length adjustable.

3. The automobile tent apparatus as in claim 1, further comprising:

a second dome support member extending between opposed distal ends of said front and back support members, respectively, said second dome support member having a tubular construction in fluid communication with said front and back support members so as to be selectively inflatable;

a second upper panel positioned atop said second dome support member that covers an upper extent of said interior area proximate said second dome support member.

4. An automobile tent apparatus configured for use in an automobile having a rear seat that extends substantially between opposed rear side doors, a front seat that extends substantially between opposed front side doors, and having a cabin ceiling above the front and rear seats, said automobile tent apparatus comprising:

a body member that includes an inflatable framework having opposed front and back support members each having opposed proximal and distal ends and a first dome support member extending between opposed proximal ends of said front and back support members, respectively, said front, back, and first dome support members having a tubular construction in fluid communication with one other and are selectively inflatable with air;

wherein said first dome support member has an upwardly arching configuration relative to said front and back support members;

a plurality of generally opaque housing panels attached to respective support members of said inflatable framework and extending downwardly therefrom so as to define an interior area within said body member;

a first upper panel positioned atop said first dome support member that covers an upper extent of said interior area proximate said first dome support member; and at least one front stabilizing strap having a configuration capable of being releasably coupled to said body portion and extending forwardly and configured to selectively attach said body portion to the front seat of the automobile and, as a result, to stabilize the body portion against movement relative to the front seat of the automobile.

5. The automobile tent apparatus as in claim 4, further comprising at least one rear stabilizing strap configured to be coupled to a back of said body portion and extending away therefrom and configured to selectively attach said body portion o the front seat of the automobile and, as a result, to stabilize the body portion against movement relative to the rear seat of the automobile.

6. The automobile tent apparatus as in claim 1, wherein said first mounting member includes a magnet configured for removably coupling said first mounting member to the cabin ceiling.

7. The automobile tent apparatus as in claim 1, wherein said inflatable framework includes at least one auxiliary dome support member having an upwardly arched configuration and positioned perpendicular to said first dome support member such that said first upper panel has a smooth dome shaped configuration resting atop said first and auxiliary dome support members.

8. The automobile tent apparatus as in claim 1, wherein:

said inflatable framework includes oppositely disposed end support members extending between respective proximal and distal ends of said front and back support members, respectively;

said plurality of housing panels includes a pair of oppositely disposed side panels extending downwardly from said end support members, respectively;

wherein each side panel defines a view opening.

9. The automobile tent apparatus as in claim 8, wherein:

said plurality of housing panels includes a front panel constructed of a flexible material that is selectively movable between a closed configuration not providing visual access to said interior area and an open configuration providing visual and physical access to said interior area;

each side panel is constructed of a flexible material that is selectively movable between a closed configuration not providing visual access to said interior area and an open configuration providing visual and physical access to said interior area.

10. The automobile tent apparatus as in claim 1, further comprising an air compressor selectively and operatively connected to said inflatable framework and configured to inflate said inflatable framework.

11. The automobile tent apparatus as in claim 1, further comprising a power inverter coupled to said body portion and configured to DC current from an automobile battery to AC current.

12. An automobile tent apparatus configured for installation in an automobile having a rear seat that extends substantially between opposed rear side doors, a front seat that extends substantially between opposed front side doors, and having a cabin ceiling above the front and rear seats, said automobile tent apparatus comprising:

a body member that includes an inflatable framework that includes:

opposed front and back support members each having opposed proximal and distal ends;

a first end support member extending between proximal ends of said front and back support members;

a second end support member extending between distal ends of said front and back support members;

a first dome support member extending between opposed proximal ends of said front and back support members, respectively, said front, back, and first dome support members having a tubular construction in fluid communication with one other and are selectively inflatable with air;

a second dome support member extending between opposed distal ends of said front and back support members, respectively, said second dome support member having a tubular construction selectively inflatable with air;

wherein said first and second dome support member have an upwardly arching configuration relative to said front and back support members;

a plurality of housing panels attached to respective support members of said inflatable framework and extending downwardly therefrom so as to define an interior area within said body member;

a first upper panel and a second upper support panel positioned atop said first dome support member and said second dome support member, respectively, that covers an upper extent of said interior area proximate said first and second dome support member, respectively;

a first mounting member configured for selective attachment to an interior surface of the cabin ceiling of the automobile, said first mounting member being coupled to said first dome support member so that said inflatable framework is suspended from the cabin ceiling.

13. The automobile tent apparatus as in claim 12, wherein said first mounting member is length adjustable.

14. The automobile tent apparatus as in claim 12, wherein said first mounting member includes a magnet configured for removably coupling said first mounting member to the cabin ceiling.

15. The automobile tent apparatus as in claim 12, further comprising a plurality of stabilizing straps, each stabilizing strap coupled to and extending away from one of a front or a back of said body portion configured to selectively attach said body portion to the front seat or rear seat of the automobile and, as a result, to stabilize said body portion against movement relative to the front seat or rear seat of the automobile.

16. The automobile tent apparatus as in claim 12, wherein said inflatable framework includes at least one auxiliary dome support member having an upwardly arched configuration and positioned perpendicular to said first dome support member such that said first upper panel has a smooth dome shaped configuration resting atop said first and auxiliary dome support members.

17. The automobile tent apparatus as in claim 12, wherein:

said plurality of housing panels includes a pair of oppositely disposed side panels extending downwardly from said first and second end support members, respectively;

each side panel defines a view opening.

18. The automobile tent apparatus as in claim 17, wherein:

said plurality of housing panels includes a front panel constructed of a flexible material that is selectively movable between a closed configuration not providing visual access to said interior area and an open configuration providing visual and physical access to said interior area;

each side panel is constructed of a flexible material that is selectively movable between a closed configuration not providing visual access to said interior area and an open configuration providing visual and physical access to said interior area.

19. The automobile tent apparatus as in claim 12, further comprising an air compressor selectively and operatively connected to said inflatable framework and configured to inflate said inflatable framework.

20. The automobile tent apparatus as in claim 12, further comprising a power inverter coupled to said body portion and configured to DC current from an automobile battery to AC current.

* * * * *